US005110389A

United States Patent [19]

Hiyoshi et al.

[11] Patent Number: 5,110,389

[45] Date of Patent: May 5, 1992

[54] THERMOSENSITIVE IMAGE TRANSFER RECORDING MEDIUM

[75] Inventors: Yoshihiko Hiyoshi, Numazu; Youji Ide, Mishima; Masanaka Nagamoto, Susono; Tetsuji Kunitake, Numazu, all of Japan

[73] Assignee: Ricoh Company, Ltd., Tokyo, Japan

[21] Appl. No.: 707,939

[22] Filed: May 28, 1991

Related U.S. Application Data

[63] Continuation of Ser. No. 334,572, Apr. 7, 1989, abandoned.

[30] Foreign Application Priority Data

Apr. 8, 1988 [JP] Japan ..... 63-86400

[51] Int. Cl.[5] ..... B41M 5/26

[52] U.S. Cl. ..... 156/234; 428/195; 428/327; 428/330; 428/331; 428/336; 428/412; 428/413; 428/473.5; 428/475.5; 428/480; 428/484; 428/488.1; 428/492; 428/500; 428/520; 428/521; 428/913; 428/914

[58] Field of Search ..... 428/195, 206, 484, 488.1, 428/488.4, 913, 327, 330, 331, 336, 412, 413, 473.5, 475.5, 480, 500, 492, 520, 521, 914; 156/234

[56] References Cited

U.S. PATENT DOCUMENTS

| | | | |
|---|---|---|---|
| 4,707,395 | 11/1987 | Ueyama et al. | 428/488.4 |
| 4,783,360 | 11/1988 | Katayama et al. | 428/212 |
| 4,839,224 | 6/1989 | Chou et al. | 428/488.1 |
| 4,880,324 | 11/1989 | Sato et al. | 428/484 |

*Primary Examiner*—Pamela R. Schwartz

*Attorney, Agent, or Firm*—Oblon, Spivak, McClelland, Maier & Neustadt

[57] ABSTRACT

A thermosensitive image transfer recording medium is disclosed, which comprises a support and a thermofusible ink layer formed thereon, comprising a thermofusible material, a coloring agent, and a filler, with the difference between the refractive index of the filler and the refractive index of the thermofusible material being 0.15 or less.

12 Claims, 1 Drawing Sheet

THERMOSENSITIVE IMAGE TRANSFER RECORDING MEDIUM

This application is a continuation of application Ser. No. 07/334,572, filed on Apr. 7, 1989, now abandoned.

BACKGROUND OF THE INVENTION

1. Field of the Invention

This invention relates to a thermosensitive image transfer recording medium, and more particularly to a multicolor thermosensitive image transfer recording medium for high-speed printing.

2. Discussion of Background

In general, thermofusible ink layers commonly used for multicolor recording comprise as the main components non-crystalline wax or non-crystalline thermofusible resin and a coloring agent. Such conventional thermofusible ink layers have the shortcoming that satisfactorily clear-cut sharp images cannot be obtained at high speed printing, for instance, of 50 characters per second (cps) or more. Furthermore these thermofusible ink layers have the shortcoming that unheated portions thereof are transferred together with heated portions to a receiving sheet.

In order to improve the sharpness of reproduced images and to prevent the occurrence of the problem of the transfer of unheated portions to a receiving sheet, it has been proposed to add fillers to such a thermofusible ink layer. By the addition of fillers to the thermofusible ink layer, the occurrence of the transfer of the unheated portion of the ink layer to a receiving sheet can be reduced to some extent, but most of available fillers such as silica and alumina have a refractive index of 1.65 to 1.75 and cover the color of coloring agents when used in combination with the conventionally employed thermofusible waxes or resins in the thermofusible ink layers, so that when such fillers are employed in a thermofusible ink layer, images produced from such a thermofusible ink layer are dark and dull, in particular when projected by an overhead projector (OHP), and when multicolor images are formed by overlapping thermofusible ink layers with different colors.

SUMMARY OF THE INVENTION

It is therefore an object of the present invention to provide a thermosensitive image transfer recording medium for high-speed (50 cps or more) printing as multicolor reproduction, which is capable of producing multicolor images having high transparency and sharpness.

The object of the present invention can be attained by a thermosensitive image transfer recording medium comprising a support, and a thermofusible ink layer formed thereon, which comprises a thermofusible material, a coloring agent, and a filler, with the difference between the refractive index of the thermofusible material and that of the filler being 0.15 or less.

DESCRIPTION OF THE PREFERRED EMBODIMENTS

According to the present invention, in a thermosensitive image transfer recording medium comprising a support, and a thermofusible ink layer formed thereon, which comprises a thermofusible material, a coloring agent and a filler, a particular filler is selectively employed in such a manner that the difference between the refractive index of the filler and that of a thermofusible resin is 0.15 or less. By use of such a filler in combination with a thermofusible resin having a small refractive index, which is usually as small as 1.45 to 1.50, clear and sharp images can be obtained without the problem of the transfer of unheated portions of the ink layer to a receiving sheet.

In the present invention, the "refractive index" means the refractive index which is determined at 20° C. by using a standard sodium light having a wavelength of 589 nm.

By referring to the accompanying drawing, the present invention will now be explained in more detail.

Figure 1:
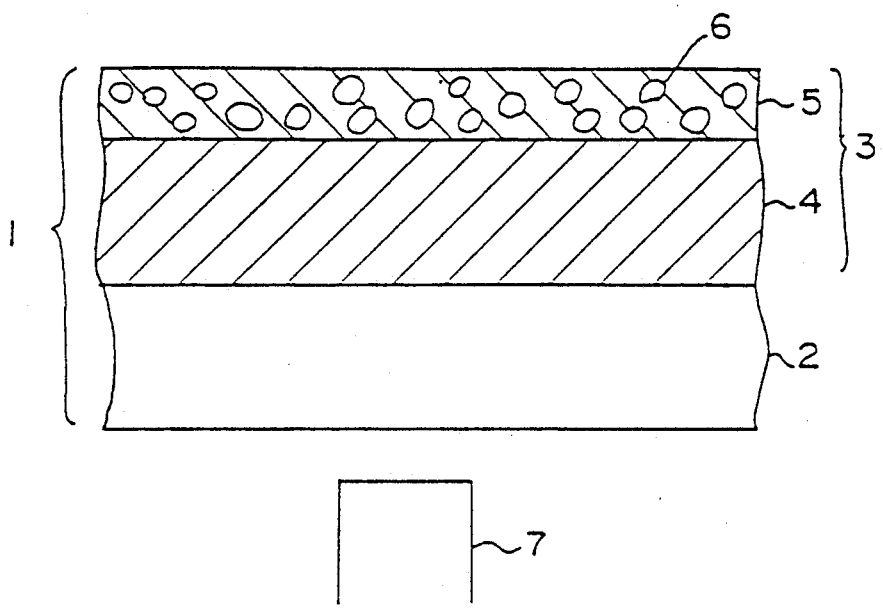
FIG. 1 is a schematic cross-sectional view of an example of a thermosensitive image transfer recording medium of the present invention.

As shown in FIG. 1, which is a schematic cross-sectional view of a basic example of a thermosensitive image transfer recording medium of the present invention, a thermosensitive image transfer recording medium 1 comprises a sheet-shaped support 2 and a thermofusible ink layer 3 formed thereon. The thermofusible ink layer 3 comprises a release layer 4 comprising a thermofusible material such as wax as the main component for facilitating the imagewise releasing of the thermofusible ink layer 3 from the support 2 during the image transfer process, and an ink layer 5 comprising as the main components a resin component, a coloring agent, and a filler 6 having such a refractive index that the difference between the refractive index of the filler and that of the resin contained in the ink layer is 0.15 or less.

It is preferable that the support 2 be made of a heat-resistant material. Examples of a heat-resistant material for the support 2 include films of heat-resistant resins such as polyester, polycarbonate, triacetylcellulose, nylon, and polyimide; cellophane; parchment paper; and condenser paper.

It is preferable that the thickness of the support 1 be in the range of 2 μm to 20 μm.

On the back side of the support 2 opposite to the thermofusible ink layer 3 thereon, with which a thermal head 7 is brought into contact, when necessary, there can be formed a heat-resistant protective layer made of silicone resin, fluorine-contained resin, polyimide resin, epoxy resin, phenolic resin, melamine resin or nitrocellulose, or a sticking-prevention layer made of, for instance, wax.

Examples of the thermofusible materials for the release layer 4 include the following waxes: natural waxes such as beeswax, carnauba wax, whale wax, Japan tallow, candellila wax, rice bran wax and montan wax; synthetic waxes such as paraffin wax, microcrystalline wax, oxidized wax, ozokelite, ceresine, ester wax and polyethylene wax; higher fatty acids such as margaric acid, lauric acid, myristic acid, palmitic acid, stearic acid, flometic acid and behenic acid; higher alcohols such as stearyl alcohol and behenyl alcohol; esters such as sorbitan fatty acid ester; and amides such as stearylamide and oleylamide.

Together with the above thermofusible materials, auxiliary components such as a viscosity adjusting agent and a softening agent can be incorporated into the release layer 4, if necessary.

The ink layer 5 formed on the release layer 4 essentially consists of an ink comprising a resin serving as the thermofusible material for the thermofusible ink layer 3 and a coloring agent.

Examples of the resin for use in the ink layer 5 include ethylene-vinyl acetate copolymer resin, ethylene-ethylacrylate copolymer resin, polyamide resin, polyester resin, epoxy resin, polyurethane resin, acryl resin, vinyl chloride resin, cellulose resin, polyvinyl alcohol resin, petroleum resin, phenolic resin, styrene resin; and elastmers such as natural rubber, styrene-butadiene rubber, isoprene rubber and chloroprene rubber. Auxiliary components such as a viscosity adjusting agent, a softening agent and a tackifier can be used along with the above resins, if necessary.

The coloring agent for use in the ink layer 3 of the invention is selected from conventionally known organic and inorganic pigments and dyes, with the heat-resistance and weather proof taken into consideration. Dyes which sublime by application of heat; dyes which are colorless at room temperature, but in which colors are developed by application of heat thereto; and dyes which are colored when brought into contact with a color developing material coated on the surface of an image transfer sheet can also be employed as the coloring agent.

Examples of such dyes are Direct Dyes such as Direct Sky Blue and Direct Black W; Acid Dyes such as Tartrazine, Acid Violet 6b and Acid Fast Red 3G; Basic Dyes such as Safranine, Auramine, Crystal Violet, Methylene Blue, Rhodamine B and Victoria Blue B; Mordant Dyes such as Sunchromine Fast Blue MB, Eriochrome Azurol B and Alizarin Yellow; Sulfur Dyes such as Sulphur Brilliant Green 4G; Building Dyes such as Indanthrene Blue; Azo Dyes such as Azo Naphthol Red 6B, Azo Violet, Azo Blue, Azo Yellow G and Azo Yellow 3G; Azoic Dyes such as Naphthol AS; Oil Dyes such as Nigrosin, Spirit Black EB, Varifast Orange 3206, Oil Black 215, Butter Yellow, Sudan Blue II, Oil Red B and Rhodamine B.

As the pigments for use in the present invention, conventionally employed pigments such as C.I. Pigment Yellow 12, Yellow FGN, Chrome Yellow, Quinoline Yellow (C.I. 47005), C.I. Pigment Red 57:1, Rose Bengale, Monastral Red, C.I. Pigment Blue 15:3, Aniline Blue, Calconyl Blue, Phthalocyanine Blue, Ultramarine Blue can be employed.

Furthermore, conventional leuco dyes for use in conventional thermosensitive materials can be also employed in the present invention. For example, triphenylmethane-type leuco compounds, fluoran-type leuco compounds, phenothiazine-type leuco compounds, auramine-type leuco compounds, spiropyran-type leuco compounds and indolinophthalide-type leuco compounds can be employed. Color formation is induced in these leuco dyes by a variety of electron acceptors or oxidizers which react with the above leuco dyes under application of heat.

As mentioned previously, the filler 6 for use in the present invention has such a refractive index that is different from that of the resin contained in the ink layer by a value of 0.15 or less. In order to obtain images with high sharpness, it is preferable that the particle size of the filler be in the range of 0.5 μm to 5 μm.

Further, in order to obtain sharp images having no voids (i.e., untransferred portions), it is preferable that the parts-by-weight ratio of the filler to the thermofusible resin (filler/resin) in the ink layer be in the range of 5/100 to 50/100.

Examples of such fillers for use in the present invention include polyvinyl chloride powder (refractive index of 1.55), calcium carbonate (same 1.48), quartz powder (same 1.46 to 1.55), polyethylene powder (same 1.51) and tetrafluoroethylene resin powder (same 1.35).

A preferable range of the thickness of the release layer 4 is from 0.5 μm to 6 μm, and that of the ink layer 5 is from 1 μm to 10 μm. The ink layer 5 may be composed of a single layer or a plurality of overlaid layers.

When the thermosensitive image transfer recording medium according to the present invention is employed in practice for obtaining multicolored or full-colored images on a receiving sheet, a set of thermosensitive image transfer media with the colors of cyan, yellow and magenta, when necessary with addition of a thermosensitive image transfer medium with a color of black, which may be in the form of a sheet or a continuous ribbon having different color sections, are successively brought into contact with the receiving sheet, and a heat application means such as a thermal head is brought into contact with the back side of the support opposite to the thermosensitive recording layer and heat is applied imagewise, so that the thermosensitive recording layer is transferred imagewise to the receiving sheet.

The present invention will now be explained more specifically by referring to following Examples and Comparative Examples. These examples are given for illustration of the invention and are not intended to be limiting thereof.

EXAMPLES 1-3

A polyethylene terephthalate (PET) film having a thickness of 3.5 μm was hot-melt coated with a mixture of the following formulation, so that a release layer having a thickness of 4.0 μm was formed on the PET film.

| [Formulation] | parts by weight |
|---|---|
| Paraffin (m.p. 68° C.) | 50 |
| Lanolin fatty acid monoglyceride (Trademark "HH-73", made by Yoshikawa Oil & Fat Co., Ltd.) | 40 |
| Liquid paraffin | 10 |

Ink compositions Nos. 1 to 3 were prepared by dispersing the following respective components in a ball mill for 12 hours.

| Example | 1 | 2 | 3 |
|---|---|---|---|
| Ink Comp. | No. 1 | No. 2 | No. 3 |
| Coloring Agent | Lionol Yellow FGN (made by Toyo Ink Mfg. Co., Ltd.) | Seika Fast Carmine 1458 (made by Dainichi-Seika Color & Chemicals Mfg. Co., Ltd.) | Lionol Blue KL (made by Toyo Ink Mfg. Co., Ltd.) |
| Color | yellow | magenta | cyan |
| Amount | 6.5 | 8.0 | 9.0 |
| Resin | Ethylene - vinylacetate copolymer resin (80/20, refractive index = 1.46) | | |
| Amount | 73.5 | 72.0 | 71.0 |
| Filler | Polyvinyl chloride powder (refractive index = 1.55) | | |

-continued

| Example | 1 | 2 | 3 |
|---|---|---|---|
| Amount | 20.0 | 20.0 | 20.0 |
| Solvent | | Isooctane | |
| Amount | 550 | 550 | 550 |

Each of the above ink compositions Nos. 1 to 3 was coated on the release layer formed on each PET film and dried, so that an ink layer having a thickness of 2 μm was formed on the release layer. Thus, thermosensitive image transfer recording media Nos. 1, 2 and 3 according to the present invention were prepared.

EXAMPLE 4

Example 2 was repeated except that the polyvinyl chloride powder employed as the filler in Example 2 was replaced with finely-divided particles of calcium carbide having a refractive index of 1.48, whereby a thermosensitive image transfer recording medium No. 4 according to the present invention was prepared.

EXAMPLE 5

Example 3 was repeated except that the polyvinyl chloride powder employed as the filler used in Example 3 was replaced with finely-divided particles of calcium carbonate having a refractive index of 1.48, whereby a thermosensitive image transfer recording medium No. 5 according to the present invention was prepared.

COMPARATIVE EXAMPLE 1

Example 2 was repeated except that the polyvinyl chloride powder employed as the filler in Example 2 was eliminated, whereby a comparative thermosensitive image transfer recording medium No. 1 was prepared.

COMPARATIVE EXAMPLE 2

Example 2 was repeated except that the filler employed in Example 2 was replaced with finely-divided particles of alumina having a refractive index of 1.75, whereby a comparative thermosensitive image transfer recording medium No. 2 was prepared.

Figure 2:
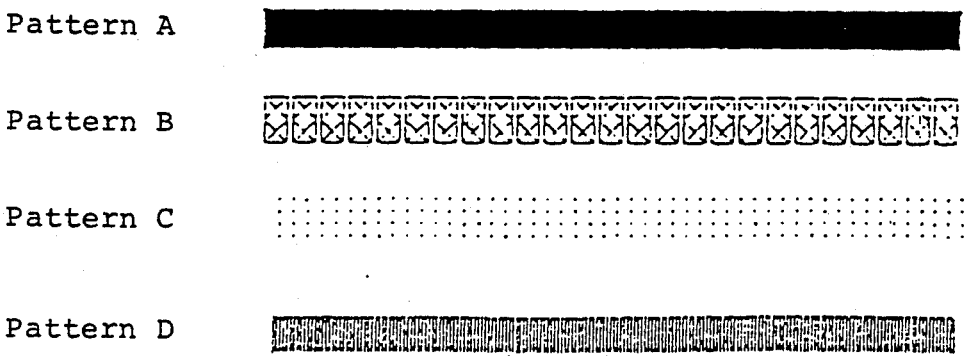
FIG. 2 is a printing test original employed for the evaluation of transferred images.

The above prepared thermosensitive image transfer recording media Nos. 1 to 5 according to the present invention, and the comparative thermosensitive image transfer recording media Nos. 1 and 2 were suvjected to the following printing test by use of a printing test original including four printing patterns A, B, C and D as shown in FIG. 2 for the evalution of (1) the transparency of printed images, (2) the quality of printed images projected by an overhead projector (OHP), (3) the transfer of unheated portions of the ink layer, (4) the transfer of heated portions of the ink layer, and (5) the sharpness of the printed images.

Printing Test

The ink layer of each thermosensitive image transfer recording medium was brought into close contact with a transfer sheet (Trademark "TYPE 1000", made by Ricoh Company, Ltd., having a Bekk's smoothness of 200 seconds), and a polyester film having a thickness of 75 μm, respectively. Thereafter, an 8 dots/mm thermal head was brought into contact with the back side of the support (i.e., opposite to the ink layer) of each of the above transfer sheet and polyester film under the following conditions to transfer images thereto.

| | |
|---|---|
| Energy Applied to Thermal Head: | 0.4 mJ/dot |
| Printing Speed: | 80 cps |
| Pressure Applied to Support by Thermal Head: | approx. 500 g/cm$^2$ |

(1) Transparency of Printed Images

The degree of cloudiness of the images printed on the polyester film by use of printing pattern A of the printing test original shown in FIG. 2 was measured by using a haze meter (made by Toyo Seiki Seisaku-Sho, Ltd.), and the transparency was calculated from the following equation. The higher the transparency, the clearer the produced images.

$$\text{Transparency (\%)} = 100 - \text{Degree of Cloudiness}$$

(2) Quality of Images Projected by OHP

The images formed on the polyester film was projected by an OHP, and the quality of the projected images was evaluated in accordance with the following criteria.

5: More than 70% of transparency; projected images are excellent in color reproduction.

4: More than 60 to 70% of transparency; projected images are grayish in color.

3: More than 50 to 60% of transparency; projected images are dark.

2: More than 40 to 50% of transparency; projected images are darker.

1: 40% or less of transparency; projected images are completely dark.

(3) Transfer of Unheated Portions of Ink Layer

The transfer of unheated portions of the ink layer to the transfer sheet was evaluated by forming images on the transfer sheet by use of printing pattern B of the printing test original shown in FIG. 2, and visually inspecting the presence of such transfer of unheated portions together with heated portions to the transfer sheet in the printed images.

(4) Transfer of Heated Portions of Ink Layer

The transfer of heated portions of the ink layer to the transfer sheet was evaluated by forming images by use of printing pattern C of the printing test original shown in FIG. 2, and by counting the number of reproduced dots out of 1,000 dits of printing pattern B.

(5) Sharpness of Transferred Images

By use of printing pattern D of the printing test original shown in FIG. 2 in which vertical line images consisting of lines with a thickness of one dot with a space of one dot between each of the lines are continuously printed, line images are formed on the transfer sheet.

The transferred line images were carefully observed, and the sharpness thereof was evaluated in accordance with the following criteria.

5: Each of the transferred lines is one dot thick.

4: Each of the transferred lines is slightly thicker than one dot.

3: Each of the transferred lines is thicker than one dot. However, there is a sufficient space between each line for distinguishing each line.

2: Each of the transferred lines is much thicker than one dot, and the space between each line is considerably narrow.

1: Each of the transferred lines is so thick that each line is not clearly distinguishable.

The results of the above evaluation are shown in the following Table 1.

TABLE 1

| | Examples | | | | | Comparative Examples | |
|---|---|---|---|---|---|---|---|
| | 1 | 2 | 3 | 4 | 5 | 1 | 2 |
| Color | Yellow | Magenta | Cyan | Magenta | Cyan | Magenta | Magenta |
| Transparency (%) | 78 | 76 | 75 | 75 | 74 | 78 | 52 |
| Transfer of Unheated Portions of Ink Layer | ○ | ○ | ○ | ○ | ○ | X | ○ |
| Transfer of Heated Portions of Ink Layer (Image Transfer) | 1000/1000 | 1000/1000 | 1000/1000 | 1000/1000 | 1000/1000 | 1000/1000 | 993/1000 |
| Sharpness of Image | 5 | 5 | 5 | 5 | 5 | 3 | 4 |
| Quality of Images projected by OHP | 5 | 5 | 5 | 5 | 5 | 5 | 3 |

○: Not transferred
X: Transferred

What is claimed is:

1. A thermosensitive image transfer recording medium comprising:
   (a) a support;
   (b) a release layer, formed on said support, comprising a thermofusible material; and
   (c) a thermofusible ink layer, formed on said release layer, comprising a thermofusible material, a coloring agent and a filler, with the difference between the refractive index of said filler and the refractive index of the thermofusible material of the ink layer being 0.15 or less.

2. The thermosensitive image transfer recording medium as claimed in claim 1, further comprising a protective layer formed on the back side of said support opposite to said thermofusible ink layer.

3. The thermosensitive image transfer recording medium as claimed in claim 1, wherein said thermofusible material for said ink layer is a resin selected from the group consisting of ethylene-vinyl acetate copolymer resin, ethylene-ethylacrylate copolymer resin, polyamide resin, polyester resin, epoxy resin, polyurethane resin, acryl resin, vinyl chloride resin, cellulose resin, polyvinyl alcohol resin, petroleum resin, phenolic resin, styrene resin, natural rubber, styrene-butadiene rubber, isoprene rubber and chloroprene rubber.

4. The thermosensitive image transfer recording medium as claimed in claim 3, wherein the parts-by-weight ratio of said filler to said resin in said ink layer is in the range of 5/100 to 50/100.

5. The thermosensitive image transfer recording medium as claimed in claim 1, wherein said filler is selected from the group consisting of polyvinyl chloride powder, calcium carbonate, quartz, polyethylene powder, and tetrafluoroethylene powder.

6. The thermosensitive image transfer recording medium as claimed in claim 1, wherein said thermofusible material for said release layer is a material selected from the group consisting of a natural wax, a synthetic wax, a higher fatty acid, a higher alcohol, a fatty acid ester, and a fatty acid amide.

7. The thermosensitive image transfer recording medium as claimed in claim 1, wherein said support is made of a heat-resistant material.

8. The thermosensitive image transfer recording medium as claimed in claim 7, wherein said heat-resistant material is selected from the group consisting of polyester, polycarbonate, triacetylcellulose, nylon and polyimide.

9. The thermosensitive image transfer recording medium as claimed in claim 7, wherein said support has a thickness ranging from 2 μm to 20 μm.

10. The thermosensitive image transfer recording medium as claimed in claim 1, wherein said ink layer has a thickness ranging from 1 μm to 10 μm.

11. The thermosensitive image transfer recording medium as claimed in claim 1, wherein said release layer has a thickness ranging from 0.5 μm to 6 μm.

12. A multicolor thermosensitive image transfer recording method of obtaining multicolored images using a plurality of thermosensitive image transfer recording media comprising (a) a support, (b) a release layer, formed on said support, comprising a thermofusible material and (c) a thermofusible ink layer, formed on said release layer, comprising a thermofusible material, a coloring agent and a filler, with the difference between the refractive index of said filler and the refractive index of the thermofusible material of the ink layer being 0.15 or less, each recording medium having different colors, said method comprising the steps of:
   successively bringing said thermofusible ink layer of each recording medium into contact with a receiving sheet; and
   imagewise transferring said thermofusible ink layer successively with application of heat thereto to said receiving sheet.

* * * * *